United States Patent [19]

Cobb

[11] Patent Number: 4,759,728

[45] Date of Patent: Jul. 26, 1988

[54] VEHICLE BATTERY JUMPER IMPROVEMENT

[76] Inventor: Jerry G. Cobb, Rte. 1, Box 15C, Gibson, La. 70356

[21] Appl. No.: 73,011

[22] Filed: Jul. 13, 1987

[51] Int. Cl.[4] ..... H01R 11/00

[52] U.S. Cl. ..... 439/503; 439/504; 439/142; 439/556

[58] Field of Search ..... 439/34, 142, 207, 208, 439/502–504, 528, 533, 535, 536, 538, 544, 545, 548, 549, 556, 562, 563, 569

[56] References Cited

U.S. PATENT DOCUMENTS

| | | | |
|---|---|---|---|
| 3,601,660 | 8/1971 | Brandt et al. | 439/34 |
| 4,072,381 | 2/1978 | Burkhart et al. | 439/503 |
| 4,106,834 | 8/1978 | Horowitz | 439/142 |

FOREIGN PATENT DOCUMENTS

| | | | |
|---|---|---|---|
| 1193149 | 10/1959 | France | 439/556 |

*Primary Examiner*—Gil Weidenfeld

*Assistant Examiner*—Paula A. Austin

*Attorney, Agent, or Firm*—John D. Jeter

[57] ABSTRACT

A junction box and battery jumper cable combination for use on vehicles with storage batteries. A cup shaped junction box has a flanged lip for mounting through body panel holes larger than the cup below the lip but smaller than the lip. Pull-in lugs on a screw actuated element are slidable along slots in the cup wall to approach the lip when the screw is actuated to secure the lip and, hence, the junction box to the body. The screw on each pull-in lug is accessible inside the junction box and access to the back side of the mounting area is not essential. Jumper cables adapted to work with the junction box has polarity selective cooperating terminals to assure correct polarity of circuitry. The jumper cables have a spring clamp equipped extension cables to mate with the end of the jumper cables to serve vehicles not equipped with the improved junction box. The junction box is adapted for wiring permanently to the host vehicle battery.

6 Claims, 2 Drawing Sheets

VEHICLE BATTERY JUMPER IMPROVEMENT

This invention pertains to equipment used on vehicular equipment and the like to facilitate the use of the battery on an able vehicle to assist the electrical system on a disabled vehicle. More specifically this invention pertains to vehicular junction boxes and associated jumper cables.

BACKGROUND

When storage batteries fail to start a vehicle, it is common practice to use jumper cables extending from the battery terminals of an able vehicle to the battery terminals of a disabled vehicle to temporarily aid in starting. Such jumper cables commonly have spring clamps, especially adapted to grip battery terminals, at each end of each of a pair of electrical conductors that have an insulation jacket.

The use of jumper cables is a recognized hazard. The batteries produce hydrogen gas when charging and sparks from the nearby jumper-to-battery terminal connection can, and often does, set off an explosion. The batteries sometimes burst from the explosion and spatter battery acid on bystanders. The spring clamps, and sometimes the wire jacket, are color coded in an effort to avoid reversed polarity jumper hook-up but reverse polarity hook-ups do occur. The electrical systems of both the vehicles may be damaged.

When using jumper cables, the hoods of both vehicles have to be lifted to reach the batteries. This occurs in the circumstance of disability of one vehicle and that may occur in situations that endanger people, usually by traffic.

Modern vehicles have less accessible batteries and battery terminals are being designed with covers that are part of the auto electrical system.

It is therefore an object of this invention to provide apparatus that permanently connects to vehicle batteries and presents a hook-up junction box on a convenient surface of the vehicle.

It is another object of this invention to provide a combination of junction box and jumper cables that assure correct polarity of connections.

It is yet another object of this invention to provide a junction box that can be inserted into a prepared hole in a surface of a vehicle body and be clamped in place without access to the back side of the area of attachment.

It is still a further object of this invention to provide a jumper cable junction box with a cover that blends with common automotive trim.

It is yet a further object of this invention to provide apparatus that will cause a warning light to glow if one of the batteries is coupled with reverse polarity.

These and other objects, advantages, and features of this invention will be apparent to those skilled in the art from a consideration of this specification, including the attached claims and appended drawings.

SUMMARY OF THE INVENTION

A hook-up junction box for battery jumper cables is adapted to be mounted on an accessible vehicle body surface with terminals permanently connected to the vehicle battery. Electric connectors in the junction box are polarity distinctive and mate with the cooperating jumper cables only with correct polarity. The junction box has pull-in lugs arranged to approach a radial flange lip on the cup shaped box when screws are turned on the box. Vehicle body material betwen the lip and the lug will be gripped to secure the box. The pull-in lugs are slidable in slots in the side of the box and can be pulled into the box when the box is inserted in a close fitting hole in the vehicle body. Permanent wiring from terminals in the junction box to the battery can be made without access to the back side of the mounting area. A dust cover is provided to push onto the junction box lip and may resemble the rest of the vehicle trim.

DETAILED DESCRIPTION OF DRAWINGS

Figure 1:
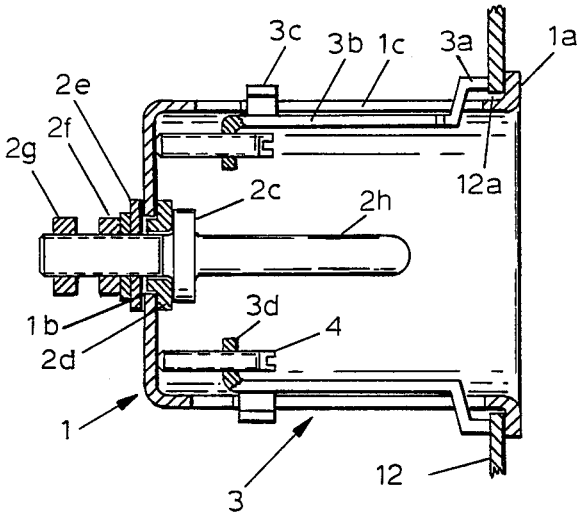
FIG. 1 is a side view, in cutaway, of the preferred embodiment of the junction box of this invention.

In the drawings wherein like features have like captions, FIG. 1 represents the preferred embodiment of the terminal box of the combination. Box 1 is of a cup shape with a radially flanged lip 1*a* at the open end. The cup bottom has two separated openings 1*b*, only one being visible. There are two separated and generally parallel terminal posts extending through holes 1*b*, one concealed behind the other. Terminal post 2*a* is visible. Terminal posts 2*a* and 2*b* are made polarity specific by making them of different diameters in the region for mating cooperating connections. Pin 2*h* is larger than the equivalent on post 2*b*. Various selective mating shapes may be used to prevent polarity errors. Terminal post 2*a* is mounted through hole 1*b* on insulated grommet 2*d* under flange 2*c*, secured by insulated washer 2*e* and nut 2*f*. Nut 2*g* will retain a battery lead terminal.

Hole 12*a* is punched or drilled in a body panel 12 of the host vehicle to allow the box to slip through until lip 1*a* is against the panel. Pull-in link 3*b* can be installed after the box is through hole 12*a*. Pull-in lug 3*a* can be pushed out from inside the box through slot 1*c*. The link, in the area of the caption 3*b* is too wide to go through slot 1*c*. Wings 3*c* can be moved from inside the box at a wide point in the slot 1*c* but rest on the outside of the box elsewhere. When screws 4 are tightened, through threaded ears 3*d* on link 3*b*, the link moves rightward pushing pull-in lug 3*a* against the body panel to secure the box in the panel.

Figure 2:
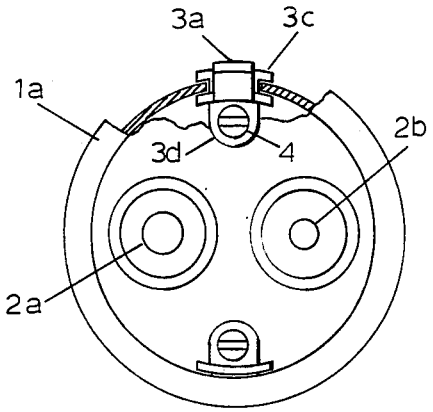
FIG. 2 is a projected view from the open end of the junction box of FIG. 1.

FIG. 2 is a view through the open end of the junction box of FIG. 1. Ears 3*d* can be seen projecting inwardly from link 3*b*. Screws 4 can be seen to be accessible from the box interior. Terminal posts 2*a* and 2*b* can be seen, separated, parallel, and extending from the bottom of the box toward the open end. The pin end of terminal post 2*b* is seen to be smaller than the pin end of post 2*a*.

Figure 3:
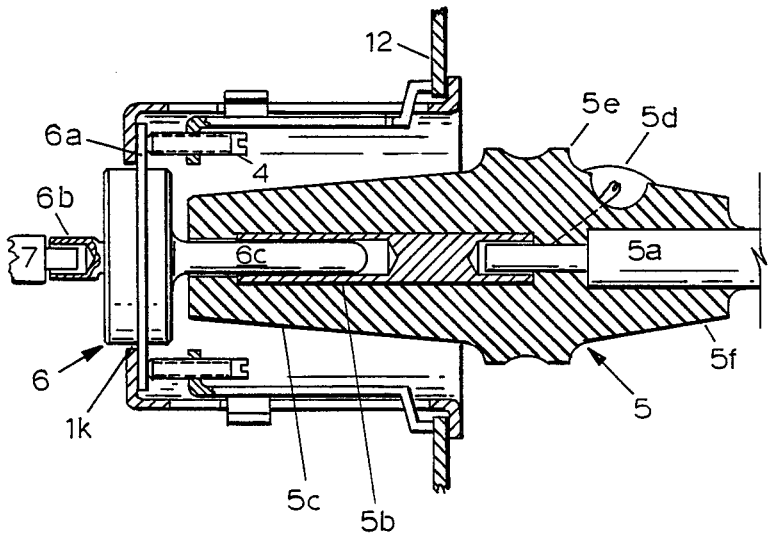
FIG. 3 is a side view, in cutaway, of an alternate configuration of a junction box mounted on a vehicle panel with a mating terminal of the associated jumper cable assembly in place.

In FIG. 3, the cup shaped terminal box is unchanged except at the bottom where a single opening 1*k* accepts common insulator block 6 which has radial flange 6*a* extending out under screws 4 to hold the insulator block in place with the same forces that secure the box to the body. Pins 6*c* extend from the terminal block and have the same function as pins 2*h*. Both terminal posts have solder cup *6b*, which may be crimped instead of soldering, to secure battery leads 7.

Jumper terminal 5 is shown connected but will be described as if pushed onto terminal posts 2*a* and 2*b*. Female friction connector 5*b* is visible, the comparable other connector is parallel and behind 5*b*, and arranged to mate with the two separated and parallel posts 2*a* and 2*b*. The connectors 5*b* are encapsulated in terminal block 5*c* which has gripper flange 5*e* and wire support 5*f* for attached and extending leads, cables, or wires, 5*a*. The leads 5*a*, an insulated pair, have a protective jacket. The jumper asembly comprises; a lead pair 5*a* of some length, a terminal at each end of the pair, one shown as terminal block 5.

Polarity warning light 5*d* will be explained later.

Figure 4:
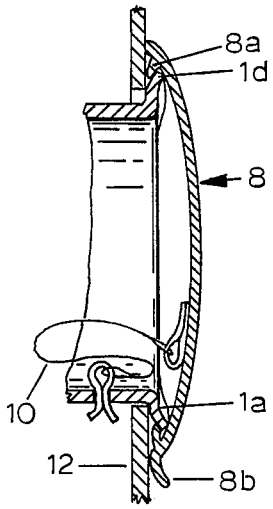
FIG. 4 is a side view, in cutaway, of the open end of the junction box with a dust cover in place.

FIG. 4 is a sectional view cut along the center line of the junction box to show lip 1*a* and a dust cover that clips on the lip. Lip 1*a* has a wedge shaped lift 1*d* at least in two places about the lip. Dust cover 8 has spring clips 8*a* that will hold to lifts 1*d* with enough friction to stay in place until the cover is pulled off. Lift 8*b* is a deformed edge of cover 8 under which a convenient tool can be inaserted to pull off the cover. A tether 10 can, optionally, be attached with one end to the cover and the other end to the junction box to avoid loss of the cover.

If both vehicles involved in the use of this system, the jumper is plugged into the junction box of each and correct polarity is assured. If however one vehicle is not equipped, the jumper will have to be connected directly to the battery terminals. An adapter will de described.

Figure 5:
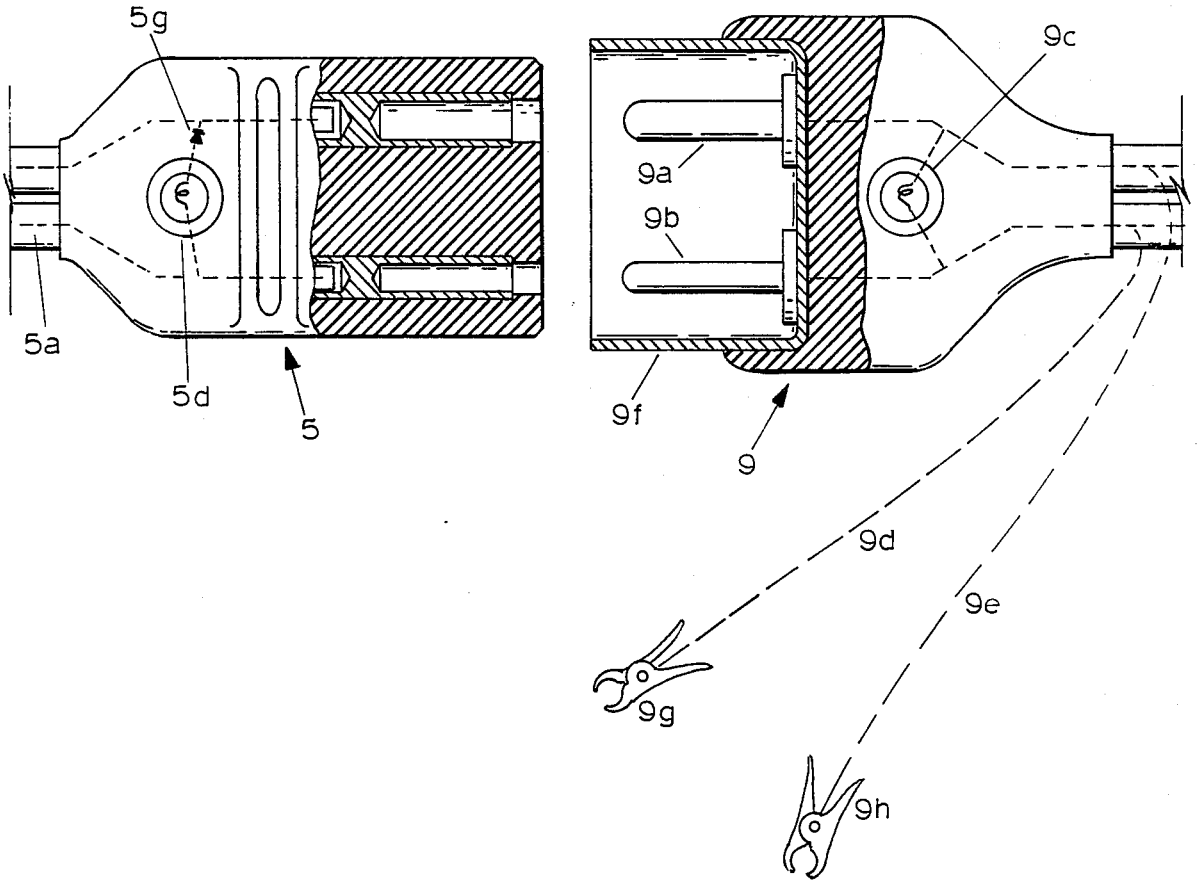
FIG. 5 is an elevation, partly in cut away, of a jumper cable terminal and an adapter for battery terminals.

FIG. 5 shows a top view of jumper terminal 5 with polarity warning light 5*d* shown schematically connected so that it will not light if polarity being arranged is correct, but will light if polarity is reversed. Diode 5*g* will flow current to activate light 5*d* if the circuit is wrong. The lamp is most important on the adapter assembly 9 and is shown as 9*c* and similarly diode connected (diode not shown). Terminal shell 9*f* has a female receptacle to protect the terminal posts 9*a* and 9*b* from short circuit with chance metal. Leads 9*d* and 9*e* are schematic as are spring clamps 9*g* and 9*h* for gripping battery terminals.

Even a nearly dead battery will cause lights 5*d* to glow. The vehicle with no junction box would be connected first and lights 5*d* would all glow as each connection is made, ideally, before finally connecting to the able battery related junction box.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

I claim:

1. An improved hook-up junction box and jumper cable combination for vehicles with bodies and storage batteries, the improvement comprising:

(a) a hook-up terminal box comprising; a generally cup shaped box with a radially flanged lip at the open end, a pair of dissimilar terminal posts insulatedly mounted in said box and extending generally parallel and separated toward said open end, a plurality of pull-in lugs extending through elongated slots in the wall of said box, said pull-in lugs having outer ears opposing said radial lip and having inner ears extending inside said box and opposing the bottom thereof and having screws extending through said inner ears arranged to bear on the bottom of said box and push said outer ears against said radial lip or material interposed therebetween, and wiring means to secure an electric conductor to each of said terminal posts;

(b) jumper cables comprising; a pair of insulated electric conductors of some length, each end of said pair of electric conductors terminating in a terminal block having separated, generally parallel, electric terminals adapted to cooperate with said pair of dissimilar terminal posts in said box, insulation of said terminal block extending beyond said electric conductor terminals such that intereference of mismatched dissimilar connectors will interefere on insulation rather than metal-to-metal contact.

2. The combination of claim 1 further providing that said pair of dissimilar terminal posts be mounted in an insulation block which protrudes through the bottom of said box, said insulation block having radial flange means adapted to be thrust against the bottom of said box by said screws.

3. The combination of claim 1 further providing a dust cover to fit over the outer dimension of said radially flanged lip, with securing lugs on said dust cover arranged to retentionally engage edges of said box when pushed onto said box.

4. The combination of claim 3 further providing a flexible tether of some length, one end of which is attached to said dust cover, the other end of which is attached to said box.

5. The combination of claim 1 further providing a pair of battery post gripping spring clamps each attached electrically to an insulated conductor of some length, the free end of said electrical conductors terminating in a cooperating adapter assembly having a terminal shell capable of mating with said terminal block on said jumper cables.

6. The combination of claim 5 further providing a polarity warning light mounted in said adapter assembly, connected to said conductors by diode series circuitry such that said polarity warning light will glow only if the voltage between said conductors is of selected polarity.

* * * * *